United States Patent [19]

Kagaya et al.

[11] Patent Number: 4,994,196

[45] Date of Patent: Feb. 19, 1991

[54] TWO-CYCLE ENGINE OIL COMPOSITION

[75] Inventors: Mineo Kagaya, Fujisawa; Mitsuaki Ishimaru, Yokohama, both of Japan

[73] Assignee: Nippon Oil Co., Ltd., Tokyo, Japan

[21] Appl. No.: 421,286

[22] Filed: Oct. 13, 1989

[30] Foreign Application Priority Data

Oct. 20, 1988 [JP] Japan ..... 63-262835

[51] Int. Cl.[5] ..... C10M 141/02

[52] U.S. Cl. ..... 252/32.5; 252/39; 252/51.5A; 252/49.6; 252/56 R; 252/56 S; 252/33.4; 252/50

[58] Field of Search ..... 252/39, 56 R, 56 S, 252/38, 32.5, 33.4, 51.5 A

[56] References Cited

U.S. PATENT DOCUMENTS 4,344,854 8/1982 Davis ..... 252/47.5

4,767,551 8/1988 Hunt ..... 252/51.5 A

*Primary Examiner*—Jacqueline V. Howard

*Attorney, Agent, or Firm*—Bucknam and Archer

[57] ABSTRACT

A two-cycle engine oil composition comprising:

(I) 100 parts by weight of a base oil composed of (A) 20 to 80% by weight of a copolymer of an $\alpha$-olefin with an ester of a dicarboxylic acid, said copolymer having a kinematic viscosity of 20 to 50 cSt at 100° C., and (B) 80 to 20% by weight of an ester of pentaerythritol with a fatty acid, said ester having a kinematic viscosity of 4 to 20 cSt at 100° C., and (II) 0.4 to 6 parts by weight of calcium phenate incorporated as an indispensable ingredient in the base oil.

6 Claims, No Drawings

TWO-CYCLE ENGINE OIL COMPOSITION

BACKGROUND OF THE INVENTION

1. Field of the Invention

The present invention relates to a two-cycle engine oil composition, and more particularly to a two-cycle engine oil composition having excellent high-temperature detergency and anti-seizure property which can contribute to an improvement in the output of an engine.

2. Prior Art

In recent years, racing has been extensively conducted under the stimulus of popularity of sports motorbikes. A racing engine is required to have a compact size, light weight and high output as compared with usual engines. Heightening of output has been achieved through improvements in suction and exhaust systems and the shape of the combustion chamber as well as the enhancement of engine speed for maximum output. It would be significant if a lubricating oil to be used in the racing engines could also contribute to an improvement in the output.

At the present time, for a two-cycle engine for racing, a special oil comprising a base oil composed of a synthetic ester oil having excellent thermal stability is used for the purpose of retaining an oil film at a high temperature. The present inventors have found that such an oil brings about a lowering in the output during the operation of the engine. It has been confirmed that like such a two-cycle engine oil comprising a synthetic ester oil as the base oil, two-cycle engine oils comprising a mineral oil and a polybutene as the base oils also bring about the above described phenomenon of the lowering in the output. Therefore, the lubricating oil has been regarded as impossible to contribute to an increase in the output of the two-cycle engine.

Under these circumstances, the present inventors had examined various synthetic oils and have made extensive and intensive studies with a view to developing a lubricating oil suitable for a two-cycle engine and, as a result, have found that an oil incorporating a particular base oil and additive can remarkably improve the output over two-cycle engine oils which have hitherto been put on the market and yet brings about no lowering in the output.

Problem to be Solved by the Invention

An object of the present invention is to provide a two-cycle engine oil having excellent high-temperature detergency and anti-seizure property which can contribute to an improvement in the output of an engine.

The two-cycle engine oil of the present invention may be a two-cycle engine oil which comprises:

(I) 100 parts by weight of a base oil composed of (A) 20 to 80% by weight of a copolymer of an α-olefin with an ester of a dicarboxylic acid, said copolymer having a kinematic viscosity of 20 to 50 cSt at 100° C., and (B) 80 to 20% by weight of an ester of pentaerythritol and a fatty acid, said ester having a kinematic viscosity of 4 to 20 cSt at 100° C., and (II) 0.4 to 6 parts by weight of calcium phenate.

The calcium phenate (II) is incorporated as an essential ingredient in the base oil (I).

The present invention will now be described in more detail.

The α-olefin/dicarboxylic acid ester copolymer, which is a component (A) of the base oil (I) is represented by the following general formula:

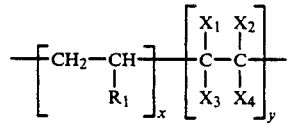

wherein $R_1$ is a straight-chain or branched alkyl group; $X_1$, $X_2$, $X_3$ and $X_4$ may be the same or different and are each hydrogen, a straight-chain or branched alkyl group, a group represented by the formula $—R_2—CO_2R_3$ or an ester group represented by the formula $—CO_2R_4$ wherein $R_2$ is a straight-chain or branched alkylene group, $R_3$ and $R_4$ may be the same or different and are each a straight-chain or branched alkyl group, any two of $X_1$, $X_2$, $X_3$ and $X_4$ are each said ester group; and x and y may be the same or different and are each a positive number.

The structure represented by the formula

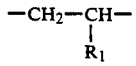

is derived from an α-olefin, and the number of carbon atoms of the α-olefin is preferably 3 to 20, still preferably 6 to 18. Examples of the α-olefin include propylene, 1-butene, 1-pentene, 1-hexene, 1-heptene, 1-octene, 1-nonene, 1-decene, 1 undecene, 1-dodecene, 1-tridecene, 1-tetradecene, 1-pentadecene, 1-hexadecene, 1-heptadecene, 1-octadecene, 1-nonadecene and 1-eicosene.

The structure represented by the formula

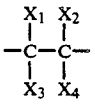

is derived from an ester of a dicarboxylic acid having ethylene linkage. Examples of the dicarboxylic acid include maleic acid, fumaric acid, citraconic acid, mesaconic acid, and itaconic acid. The alcohol is preferably one having 1 to 20 carbon atoms, still preferably one having 3 to 8 carbon atoms. Examples of the alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol and eicosanol. The component (A) is prepared by copolymerizing the above-described α-olefin with the above-described ester of a dicarboxylic acid. This process is described in detail in Japanese Pat. Application Laid-Open Gazette No. (Sho.) 58-65246. The molar ratio of the α-olefin (x) to the ester (y) of a dicarboxylic acid is preferably x:y=1:9 to 9:1. The average molecular weight of component (A) is preferably 1000 to 3000. The kinematic viscosity of component (A) should be 20 to 50 cSt at 100° C., preferably 30 to 40 cSt at 100° C. When the kinematic viscosity is less than 20 cSt or exceeds 50 cSt, improvements in the output of the engine, which are characteristic of the present invention, cannot be attained unfavorably.

The ester of pentaerythritol with a fatty acid as component (B) of the base oil (I) is represented by the following general formula:

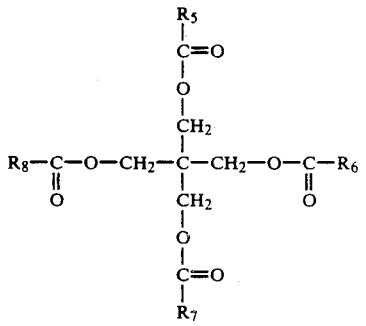

wherein $R_5$, $R_6$, $R_7$ and $R_8$ may be the same or different and are each a straight-chain or branched alkyl group. This ester can be prepared by esterifying pentaerythritol with a fatty acid. The fatty acid is preferably one having 2 to 20 carbon atoms, particularly preferably 3 to 16 carbon atoms. Examples of the fatty acid include acetic acid, propionic acid, butyric acid, iso-butyric acid, valeric acid, iso-valeric acid, pivalic acid, hexanoic acid, iso-hexanoic acid, heptanoic acid, iso-heptanoic acid, octanoic acid, iso-octanoic acid, nonanoic acid, iso-nonanoic acid, decanoic acid, iso-decanoic acid, undecanoic acid, iso-undecanoic acid, lauric acid, iso-lauric acid, tridecanoic acid, iso-tridecanoic acid, myristic acid, iso-myristic acid, pentadecanoic acid, iso-pentadecanoic acid, palmitic acid, iso-palmitic acid, heptadecanoic acid, iso-heptadecanoic acid, stearic acid, iso-stearic acid, nonadecanoic acid, iso-nonadecanoic acid, eicosanoic acid and iso-eicosanoic acid.

The kinematic viscosity of component (B) should be 4 to 20 cSt at 100° C., preferably 5 to 10 cSt at 100° C. When the kinematic viscosity is less than 4 cSt or exceeds 20 cSt, improvements in the output of the engine which are characteristic of the present invention cannot be attained unfavorably.

The above-described component (A) is mixed with the above-described component (B) to prepare the base oil (I). In this case, the amount of component (A) should be 20 to 80% by weight, preferably 30 to 70% by weight based on the whole base oil (I), while the amount of component (B) should be 80 to 20% by weight, preferably 70 to 30% by weight based on the whole base oil (I). When the proportion of incorporation does not satisfy the above-described numeral requirements, no improvement in the output of the engine can be attained unfavorably. The kinematic viscosity of the base oil (I) is preferably 10 to 25 cSt at 100° C.

The calcium phenate as component (II) of the present invention may be one or more of compounds represented by the following general formula:

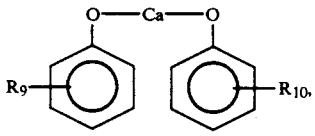

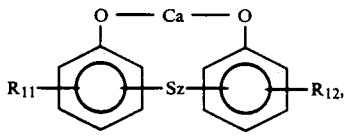

-continued

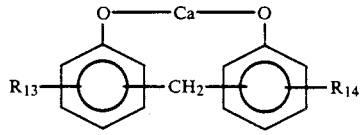

wherein, $R_9$, $R_{10}$, $R_{11}$, $R_{12}$, $R_{13}$ and $R_{14}$ may be the same or different and are each a straight-chain or branched alkyl group preferably having 4 to 30 carbon atoms, more preferably having 6 to 18 carbon atoms. Component (II) is preferably one having a base value of 30 to 300, more preferably one having a base value of 50 to 100 as determined according to the perchloric acid method. The amount of component (II) incorporated should be 0.4 to 6 parts by weight, preferably 1 to 4 parts by weight based on 100 parts by weight of the base oil (I). When the amount incorporated is less than 0.4 parts by weight, piston detergency is lowered, while when it exceeds 6 parts by weight, the amount of deposit within the combustion chamber is increased. Therefore, either case is unfavorable.

The two-cycle engine oil composition of the present invention may further contain various known additives for the purpose of further improving the excellent performance. Examples of the additive include detergent-dispersants such as alkaline earth metal sulfonates, alkaline earth metal phosphonates, alkenylsuccinimides, boric acid-modified alkenylsuccinimides, polyoxyalkylene aminoamides and benzylamines, pour point depressants such as polymethacrylate, extreme-pressure agents such as phosphorus-, sulfur- or nitrogen-derived compounds, rust preventives, and antifoamers. The amount of these various additives added is preferably 0.5 to 10 parts by weight, more preferably 1 to 5 parts by weight based on 100 parts by weight of the base oil (I).

The two-cycle engine oil composition of the present invention is suitable particularly for a two-cycle engine for racing by virtue of its characteristics which can contribute to an improvement in the output of the engine. Further, the two-cycle engine oil composition of the present invention can be favorably used also for other two-cycle engines for e.g., two-wheelers, four-wheelers, ships, agricultural vehicles, and an electric dynamo.

EXAMPLES

The present invention will now be described in more detail with reference to the following Examples and Comparative Examples.

EXAMPLES 1 TO 6 AND COMPARATIVE EXAMPLES 1 to 9

Each of the base oils shown in Table 1 was mixed with calcium phenate and other additives in proportions shown therein to prepare engine oil compositions.

The kinematic viscosities of components (A), (B) and the engine oil composition are also shown in Table 1.

The performance of the engine oil composition was evaluated by the following tests (storage stability test, engine output test, engine seizure test, and engine detergency test). The results are shown in Table 2.

(1) Storage Stability Test

Each composition of the Examples and the Comparative Examples was allowed to stand at room temperature for one week. The composition which was not found to become turbid was regarded as being acceptable, while the composition which was found to become turbid was regarded as being unacceptable.

(2) Engine Output Test

A two-cycle engine of an air-cooled single cylinder having a displacement of 123 cc was used as the test engine. The output of the test engine was stabilized at 7000 rpm and 5000 rpm under conditions of full load, a fuel-engine oil mixing ratio of 20:1 and a plug seat temperature of 254° C., and the stabilized output at that time was measured. The output of a commercially available engine oil for racing was used as a control to represent the percentage improvement of the output in terms of %.

(3) Engine Seizure Test

The same engine as that used in the test described in the above item (2) was used, and the engine was run at 7000 rpm under conditions of full load, a fuel-engine oil mixing ratio of 35:1 and a plug seat temperature of 250° C. for 3 hr. Then the states of the piston skirt and the cylinder liner were observed. The oil composition which was appreciated to bring about no seizure was regarded as being acceptable.

(4) Engine Detergency Test

The same engine as that used in the test described in the above item (2) was used, and the engine was run at 7000 rpm under conditions of full load, a fuel-engine oil mixing ratio of 20:1 and a plug seat temperature of 300° C. for 3 hr. Six places, i.e., the first ring, the second ring, the first ring land, the second ring land, piston skirt and piston underside, were observed. The cleanliness of each place was evaluated on the basis of 10 points, and the overall merit rating was determined (0=the worst, 60=the best).

TABLE 1

| Ex. and Comp. Ex. | (I) Base oil (100 pts. wt.) *1 kinematic viscosity of component (A) | kinematic viscosity of component (B) | (II) calcium phenate (pts. wt.) *2 | Other additive (pts. wt.) | Kinematic viscosity of the composition (cSt at 100° C.) |
|---|---|---|---|---|---|
| Ex. 1 | 35 (30) | 5.8 (70) | 2.5 | alkenylsuccinbisimide (5.0) | 11.2 |
| Ex. 2 | 35 (50) | 5.8 (50) | 2.5 | alkenylsuccinbisimide (5.0) | 15.5 |
| Ex. 3 | 35 (70) | 5.8 (30) | 2.5 | alkenylsuccinbisimide (5.0) | 22.0 |
| Ex. 4 | 35 (70) | 5.8 (30) | 2.5 | alkenylsuccinbisimide (2.5)<br>alkenylsuccinbisimide (2.5) | 21.0 |
| Ex. 5 | 22 (40) | 18.5 (60) | 1.2 | benzylamine (5.0) | 22.0 |
| Ex. 6 | 49 (22) | 10.3 (78) | 4.5 | alkenylsuccinbisimide (5.0) | 15.9 |
| Comp. Ex. 1 | commercially available two-cycle engine oil for racing (synthetic ester oil) | | | | 21.0 |
| Comp. Ex. 2 | 65 (24) | 5.8 (76) | 2.5 | alkenylsuccinbisimide (5.0) | 21.0 |
| Comp. Ex. 3 | 17.2 (24) | 5.8 (76) | 2.5 | alkenylsuccinbisimide (5.0) | 9.82 |
| Comp. Ex. 4 | 35 (44) | 29.5 (56) | 2.5 | alkenylsuccinbisimide (5.0) | 34.0 |
| Comp. Ex. 5 | 35 (30) | 5.8 (70) | 0 | alkenylsuccinbisimide (5.0) | 10.5 |
| Comp. Ex. 6 | 35 (30) | 5.8 (70) | 2.5 *3 | alkenylsuccinbisimide (5.0) | 11.2 |
| Comp. Ex. 7 | 35 (44) | 4.3 (56) *4 | 2.5 | alkenylsuccinbisimide (5.0) | 11.2 |
| Comp. Ex. 8 | mineral oil SAE30(64), SAE20(36) | | 2.5 | alkenylsuccinbisimide (5.0) | 11.4 |
| Comp. Ex. 9 | polybutene-1(33), polybutene-2(67) *5 | | 2.5 | alkenylsuccinbisimide (5.0) | 11.2 |

TABLE 2

| Ex. and Comp. Ex. | (1) Storage stability test | (2) Engine output test (percentage improvement of output: %) 7000 rpm | 5000 rpm | (3) Engine seizure test | (4) Engine detergency test |
|---|---|---|---|---|---|
| Ex. 1 | acceptable | 5.1 | 20.0 | acceptable | 45.1 |
| Ex. 2 | acceptable | 4.5 | 19.6 | acceptable | 46.2 |
| Ex. 3 | acceptable | 4.3 | 19.3 | acceptable | 47.1 |
| Ex. 4 | acceptable | 4.3 | 17.8 | acceptable | 44.3 |
| Ex. 5 | acceptable | 4.2 | 16.5 | acceptable | 43.5 |
| Ex. 6 | acceptable | 3.9 | 16.2 | acceptable | 42.8 |
| Comp. Ex. 1 | acceptable | reference | reference | lowering in output | 25.5 |
| Comp. Ex. 2 | acceptable | −0.1 | 15.4 | acceptable | — |
| Comp. Ex. 3 | acceptable | 0.2 | 3.7 | acceptable | — |
| Comp. Ex. 4 | acceptable | −3.8 | −2.6 | acceptable | — |
| Comp. Ex. 5 | — | — | — | — | 23.3 |
| Comp. Ex. 6 | unacceptable | — | — | — | — |
| Comp. Ex. 7 | acceptable | 0.1 | 16.5 | acceptable | — |
| Comp. Ex. 8 | acceptable | 2.4 | — | — | 26.8 |

TABLE 2-continued

| Ex. and Comp. Ex. | (1) Storage stability test | (2) Engine output test (percentage improvement of output: %) 7000 rpm | 5000 rpm | (3) Engine seizure test | (4) Engine detergency test |
|---|---|---|---|---|---|
| Comp. Ex. 9 | acceptable | 0.0 | — | — | 37.0 |

Note:
*1: Numerical value shown in parentheses is the proportion of incorporation (% by weight).
*2: Base value according to perchloric acid method: 70
*3: Calcium sulfonate was used (base value according to perchloric acid method: 22).
*4: Trimethylolpropane was used.
*5: Polybutene-1 having an average molecular weight of 750; polybutene-2 having an average molecular weight of 310.

As is apparent from Table 2, all the two-cycle engine oils of the present invention exhibit an improvement in the output over the commercially available engine oil for racing shown in Comparative Example 1 and are superior in storage stability, anti-seizure property, and detergency as well.

On the other hand, the commercially available engine oil for racing exhibited a lowering in the engine output (a premonition of seizure) under a high load. When the viscosity of the base oil used is outside the scope of the present invention (Comparative Examples 2 to 4) or when trimethylolpropane was used instead of component (B) (Comparative Example 7), insignificant improvement in the output or a lowering in the output was observed as compared with the commercially available engine oil for racing. Further, when no component (II) was used (Comparative Example 5), the engine detergency was poor, while when calcium sulfonate was used instead of component (II) (Comparative Example 6), the storage stability was poor. When a mineral oil (Comparative Example 8) or polybutene (Comparative Example 9) was used as the base oil, no significant improvement in the output was attained over the commercially available engine oil for racing, and the detergency was inferior.

Effect of the Invention

As described above, the two-cycle engine oil of the present invention is an engine oil which improves the engine in output and is excellent in storage stability, anti seizure property, and detergency as well.

What is claimed is:

1. A two cycle engine oil composition comprising:
(I) 100 parts by weight of a base oil composed of (A) 20 to 80% by weight of a copolymer of an α-olefin with an ester of a dicarboxylic acid, said copolymer having a kinematic viscosity of 20 to 50 cSt at 100° C., and (B) 80 to 20% by weight of an ester of pentaerythritol and a fatty acid, said ester having a kinematic viscosity of 4 to 20 cSt at 100° C., and
(II) 0.4 to 6 parts by weight of calcium phenate mixed in the base oil.

2. The engine oil composition according to claim 1 wherein said copolymer has the formula:

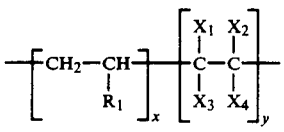

wherein $R_1$ is a straight-chain or branched alkyl; $X_1$, $X_2$, $X_3$ and $X_4$ are the same of different and are hydrogen, a straight-chain or branched alkyl, a group represented by the formula $—R_2—CO_2R_3$ or an ester group represented by the formula $—CO_2R_4$ wherein $R_2$ is a straight-chain or branched alkylene, $R_3$ and $R_4$ are the same or different and are each a straight-chain or branched alkyl, any two of $X_1$, $X_2$, $X_3$ and $X_4$ are each said ester group; and x:y = 1:9 to 1:9.

3. The composition according to claim 2 wherein in said copolymer the group

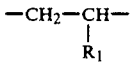

is derived from an α-olefin of 3 to 20 carbon atoms.

4. The composition according to claim 3 wherein said copolymer is prepared by copolymerizing said α-olefin with an ester of said dicarboxylic acid having an ethylene linkage in the molar ratio of the α-olefin (x) to the ester (y) of said dicarboxylic acid x:y = 1:9 to 9:1 and the average molecular weight of component (A) is 1000 to 3000.

5. The composition according to claim 1 wherein said ester of pentaerythritol and a fatty acid has the formula:

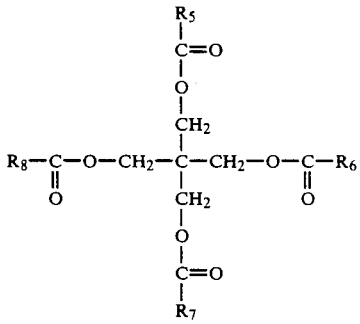

wherein $R_5$, $R_6$, $R_7$ and $R_8$ are the same or different and are each a straight-chain or branched alkyl.

6. The composition according to claim 1 which contains an additive which is a member selected from the group consisting of an alkaline earth metal sulfonate, an alkaline earth metal phosphonate, an alkenylsuccinimide, a boric acid-modified alkenylsuccinimide, a polyoxyalkylene aminoamide, benzylamine, a pour point depressant, an extreme-pressure agent, a rust preventive agent and an antifoamer in the amount of 0.5 to 10 parts by weight, based on 100 parts by weight of said base oil (I).

* * * * *